US008813999B2

(12) United States Patent
Cittadino

(10) Patent No.: US 8,813,999 B2
(45) Date of Patent: Aug. 26, 2014

(54) SYSTEMS AND METHODS INVOLVING PRODUCT DISPENSERS

(75) Inventor: Antonio M. Cittadino, Appleton, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 221 days.

(21) Appl. No.: 13/182,681

(22) Filed: Jul. 14, 2011

(65) Prior Publication Data

US 2013/0018506 A1 Jan. 17, 2013

(51) Int. Cl.

| | |
|---|---|
| ***B67B 7/00*** | (2006.01) |
| ***G01F 11/00*** | (2006.01) |
| ***B67D 1/00*** | (2006.01) |
| ***B67D 7/26*** | (2010.01) |
| ***G04C 23/00*** | (2006.01) |
| ***G05D 7/00*** | (2006.01) |
| ***G08B 1/00*** | (2006.01) |

(52) U.S. Cl.

USPC ..... 222/1; 222/27; 222/33; 222/644; 222/646; 340/309.16

(58) Field of Classification Search

CPC ..... A47K 5/1202; A47K 5/1217; A61L 9/14; B65D 83/262; B05B 12/02

USPC ..... 222/1, 23, 25, 27, 32, 33, 52, 333, 638, 222/639, 642, 644–646; 221/15; 340/309.8, 340/309.9, 309.16; 700/240, 283; 53/498–500

See application file for complete search history.

(56) References Cited

U.S. PATENT DOCUMENTS

| | | | | |
|---|---|---|---|---|
| 4,921,150 | A | 5/1990 | Lagergren et al. | |
| 5,397,028 | A | 3/1995 | Jesadanont | |
| 6,375,038 | B1 * | 4/2002 | Daansen et al. | 222/52 |
| 6,644,507 | B2 * | 11/2003 | Borut et al. | 222/37 |
| 7,554,084 | B2 * | 6/2009 | Mok et al. | 250/338.1 |
| 7,611,030 | B2 * | 11/2009 | Reynolds et al. | 222/1 |
| 7,837,065 | B2 * | 11/2010 | Furner et al. | 222/52 |
| 8,020,734 | B1 * | 9/2011 | Vandendries et al. | 222/52 |
| 8,061,562 | B2 * | 11/2011 | Carpenter et al. | 222/52 |

(Continued)

FOREIGN PATENT DOCUMENTS

WO 2008/095187 A1 8/2008

OTHER PUBLICATIONS

International Search Report and The Written Opinion of the International Searching Authority for PCT/US2012/046499 mailed Jan. 21, 2013.

*Primary Examiner* — Paul R Durand
*Assistant Examiner* — Matthew Lembo
(74) *Attorney, Agent, or Firm* — Sutherland, Asbill & Brennan, LLP

(57) ABSTRACT

A method includes determining whether an object is sensed by a sensor, dispensing a product responsive to determining that the object has been sensed, setting an object clear time value to a first value, setting a first timer to a first time period and starting the timer, starting a second timer with the set object clear time, determining whether the first timer has expired, determining whether an object is sensed by the sensor responsive to determining that the first timer has not expired, determining whether the second timer has expired responsive to determining that an object is not sensed by the sensor, setting the first timer to a second time period and starting the first timer responsive to determining that the second timer has expired.

26 Claims, 9 Drawing Sheets

(56) References Cited

U.S. PATENT DOCUMENTS 8,087,543 B2 * 1/2012 Yang et al. ..... 222/52
2010/0012679 A1 * 1/2010 Brownlee ..... 222/52
2010/0268381 A1 * 10/2010 Goerg et al. ..... 700/244
2011/0095044 A1 * 4/2011 Sipinski ..... 222/1

* cited by examiner

SYSTEMS AND METHODS INVOLVING PRODUCT DISPENSERS

BACKGROUND OF THE INVENTION

The subject matter disclosed herein relates to product dispensers, and particularly to dispensers that dispense flowable liquids.

Product dispensers may include a flowable liquid reservoir that contains a flowable liquid. A pump is connected to the reservoir and may be actuated by a motor or other automated pumping arrangement. The pump may be actuated by a user actuating a switch or a proximity sensor. The proximity sensor may include, for example, an infrared sensor or other sensor configured to detect the proximity of an object such as the hand of a user and actuate the pumping arrangement to dispense the flowable liquid into the hand of the user.

BRIEF DESCRIPTION OF THE INVENTION

According to one aspect of the invention, a method for dispensing a product includes determining whether an object is sensed by a sensor, dispensing a product responsive to determining that the object has been sensed by the sensor, setting an object clear time value to a first value, setting a first timer to a first time period and starting the first timer, starting a second timer with the set object clear time, determining whether the first timer has expired, determining whether an object is presently sensed by the sensor responsive to determining that the first timer has not expired, determining whether the second timer has expired responsive to determining that an object is not presently sensed by the sensor, and setting the first timer to a second time period and starting the first timer responsive to determining that the second timer has expired.

According to another aspect of the invention, a dispensing system includes a sensor, a product dispensing portion, and a processor communicatively connected to the sensor and the product dispensing portion. The processor is operative to determine whether an object is sensed by the sensor, dispense a product responsive to determining that the object has been sensed by the sensor, set an object clear time value to a first value, set a first timer to a first time period and start the first timer, start a second timer with the set object clear time, determine whether the first timer has expired, determine whether an object is presently sensed by the sensor responsive to determining that the first timer has not expired, determine whether the second timer has expired responsive to determining that an object is not presently sensed by the sensor, set the first timer to a second time period and starting the first timer responsive to determining that the second timer has expired.

According to yet another aspect of the invention, a method for dispensing a product includes determining whether an object is sensed by a sensor, incrementing a dispense counter, dispensing a product responsive to determining that the object has been sensed by the sensor, determining whether the dispense counter has an incremented value greater than a threshold value, setting the first timer to a first time period and starting the first timer responsive to determining that the dispense counter has an incremented value greater than the threshold value, determining whether the first timer has expired, and setting the first timer to a second time period and starting the first timer responsive to determining that the first timer has expired.

According to yet another aspect of the invention, a method for dispensing a product includes determining whether an object is sensed by a sensor, turning on a visual indicator responsive to determining that the object has been sensed by the sensor, dispensing a product, determining whether the sensor is obstructed, and turning off the visual indicator responsive to determining that sensor is not obstructed.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1A:
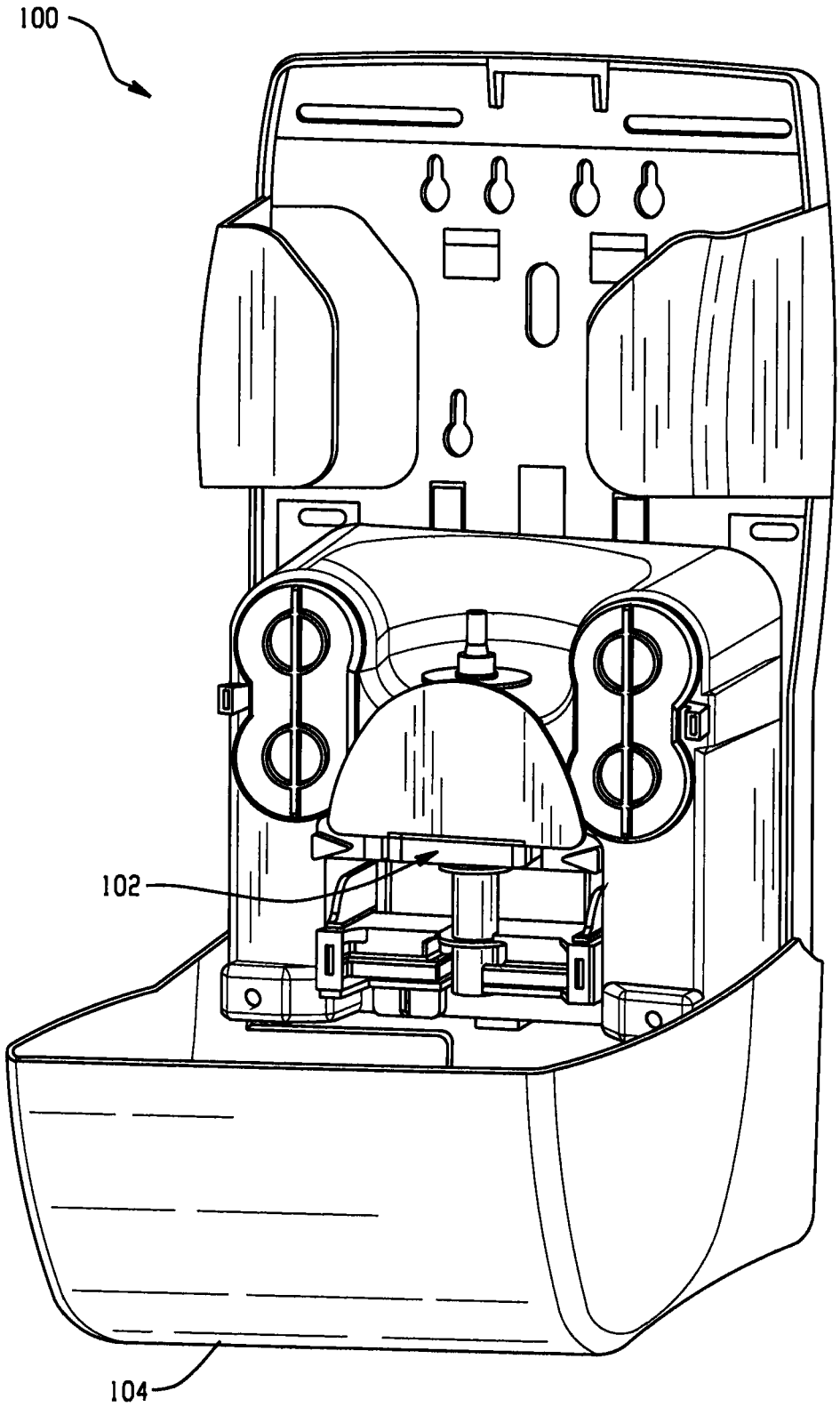
FIGS. 1A and 1B illustrate an exemplary embodiment of a dispenser system.
Figure 1B:
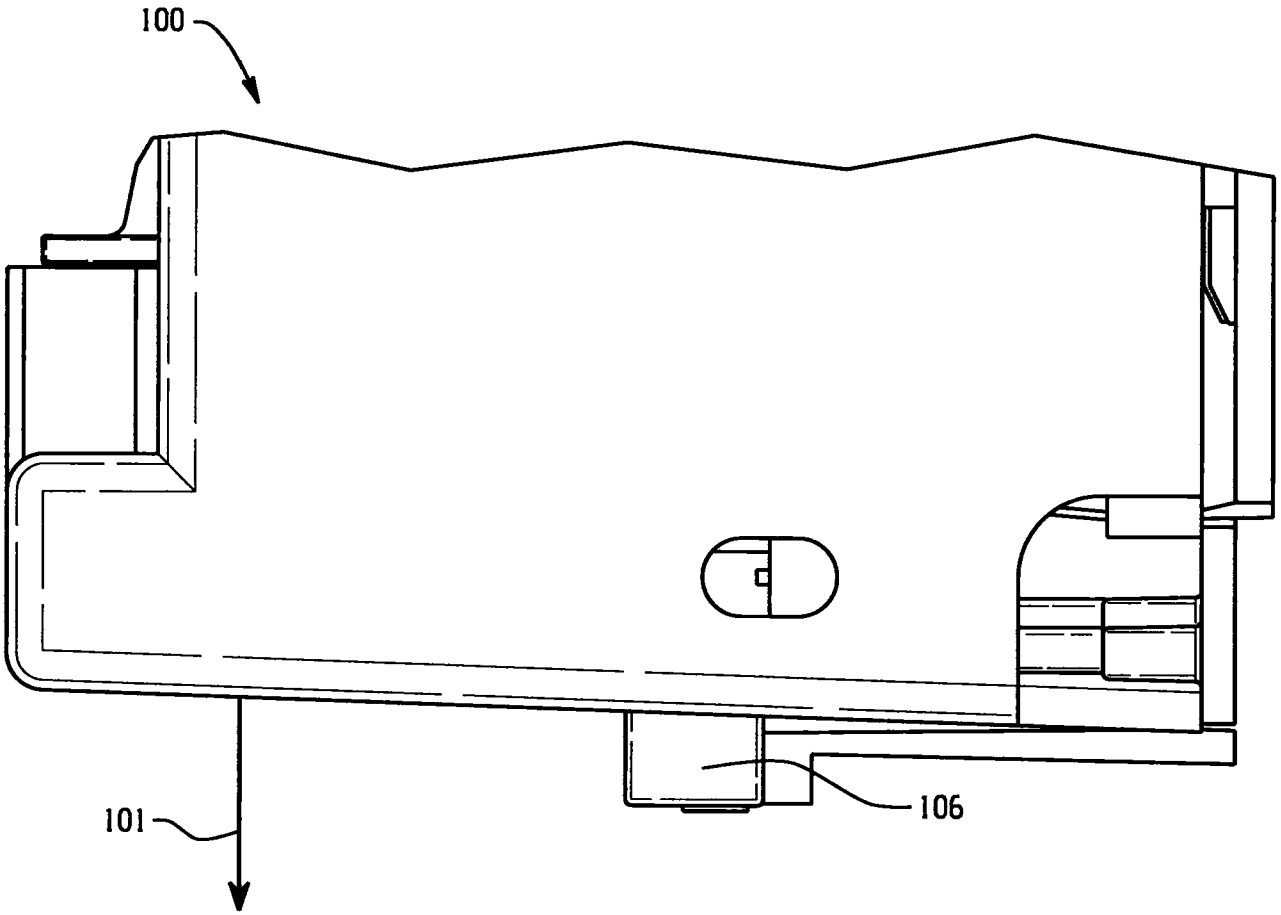

FIGS. 1A and 1B illustrate an exemplary embodiment of a dispenser system (dispenser) 100. Referring to FIG. 1A, the dispenser 100 includes a motor driven pump portion 102 and a housing portion 104 disposed in an open position. FIG. 1B illustrates a side view of a portion of the dispenser 100. The dispenser 100 includes a sensor portion (sensor) 106. The sensor 106 is operative to detect the presence of an object, such as a user's hand for example, placed below the sensor 106. When an object is sensed, the dispenser 100 dispenses a flowable liquid product such as, for example, a soap product, illustrated by the line 101. In some instances, the flowable liquid, or another object may obscure the sensor 106. In this regard, the flowable liquid may adhere to a portion of the sensor 106, which may result in an undesired dispensing of the product.

While reference is made herein to soap or liquid soap, it will be appreciated that the scope of the invention is not so limited, and extends to other flowable products, such as liquid, foam, gel, lotion, detergent, or any other flowable product capable of being pumped from a dispenser, for example.

Figure 2:
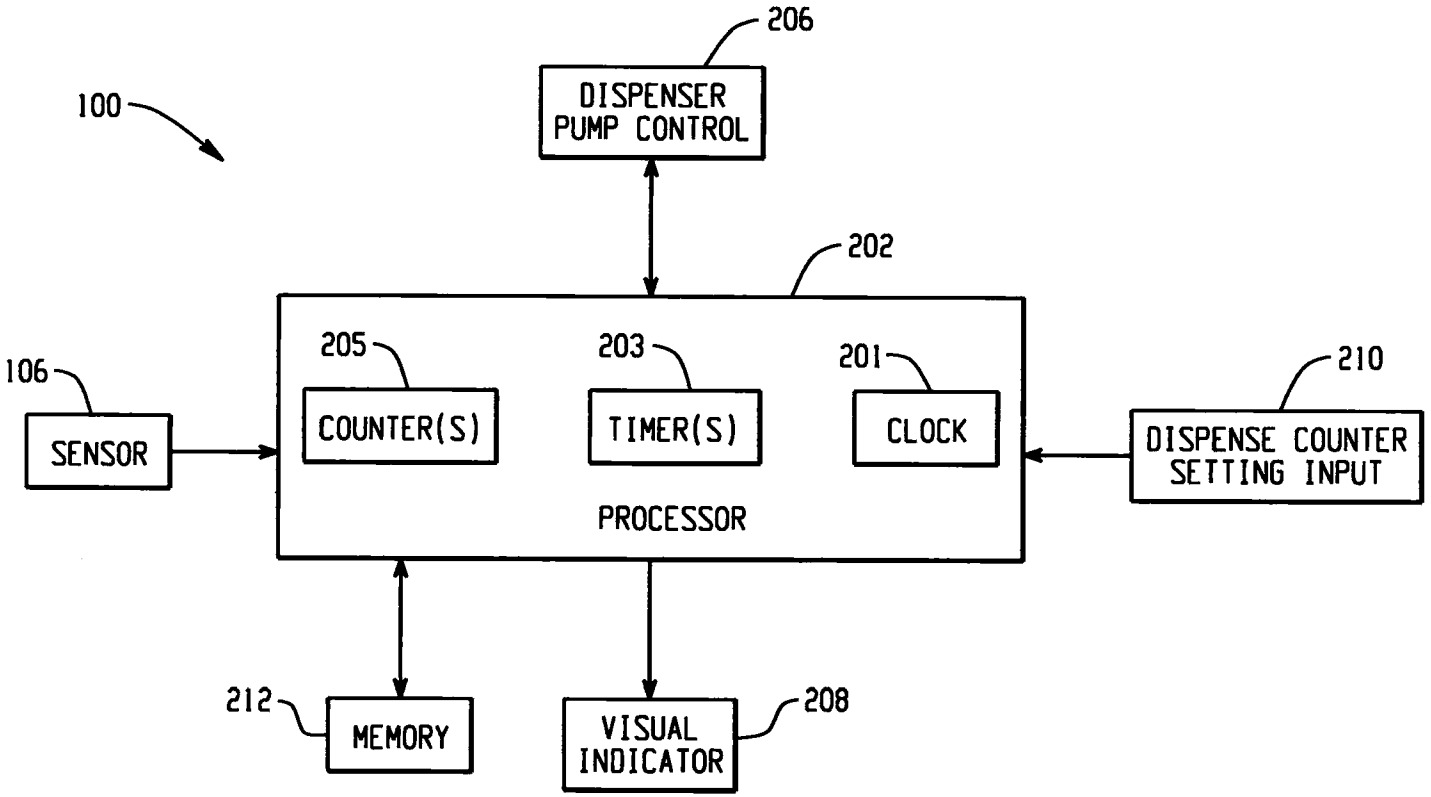
FIG. 2 illustrates a block diagram of a portion of an exemplary embodiment of the system of FIGS. 1A and 1B.

FIG. 2 illustrates a block diagram of a portion of an exemplary embodiment of the dispenser 100. The dispenser 100 includes a processor 202 that is operative to perform logic functions. The processor 202 includes a clock 201, one or more timers 203, and one or more counters 205. The processor 202 is communicatively connected to a memory portion 212, and the sensor 106 that is operative to sense a proximate object and output a signal to the processor 202 that is indicative of a sensed object. The processor 202 is also communicatively connected to a dispenser pump control portion 206 that is operative to receive signals from the processor 202 that direct the dispenser pump control portion 206 to dispense a flowable liquid. The processor 202 may actuate a visual indicator 208 that may include, for example, a light or other visual indicator indicative of a function of the dispenser 100. A dispense counter setting input 210 may be used by a user to set a function of the dispenser 100. For example, the dispense counter setting input 210 may include a switch or other type of input device operable by a user to control logic functions of the dispenser 100 via the processor 202.

Figure 3A:
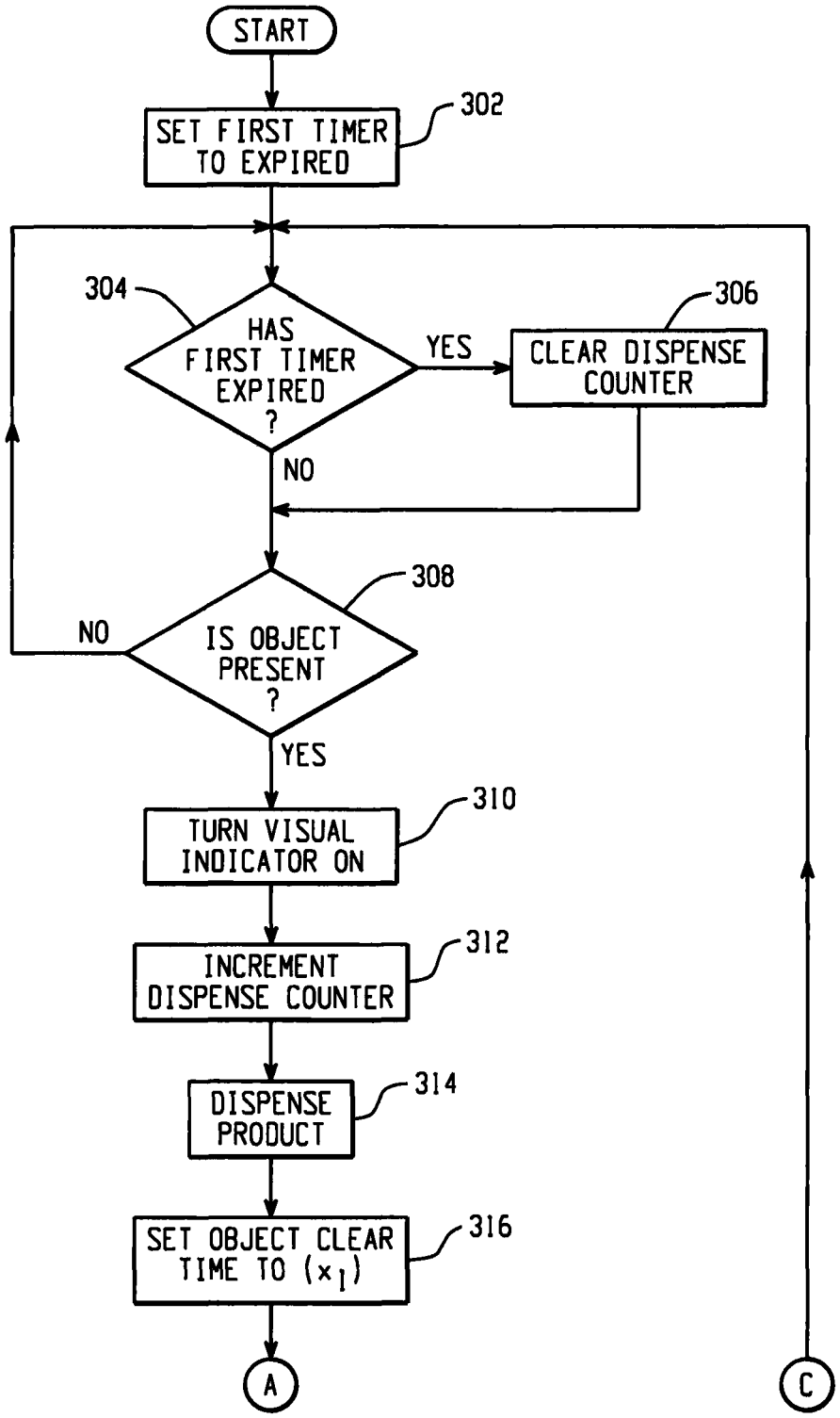
FIGS. 3A-3C include a block diagram of an exemplary method of operation of the system of FIGS. 1A, 1B, and 2.
Figure 3B:
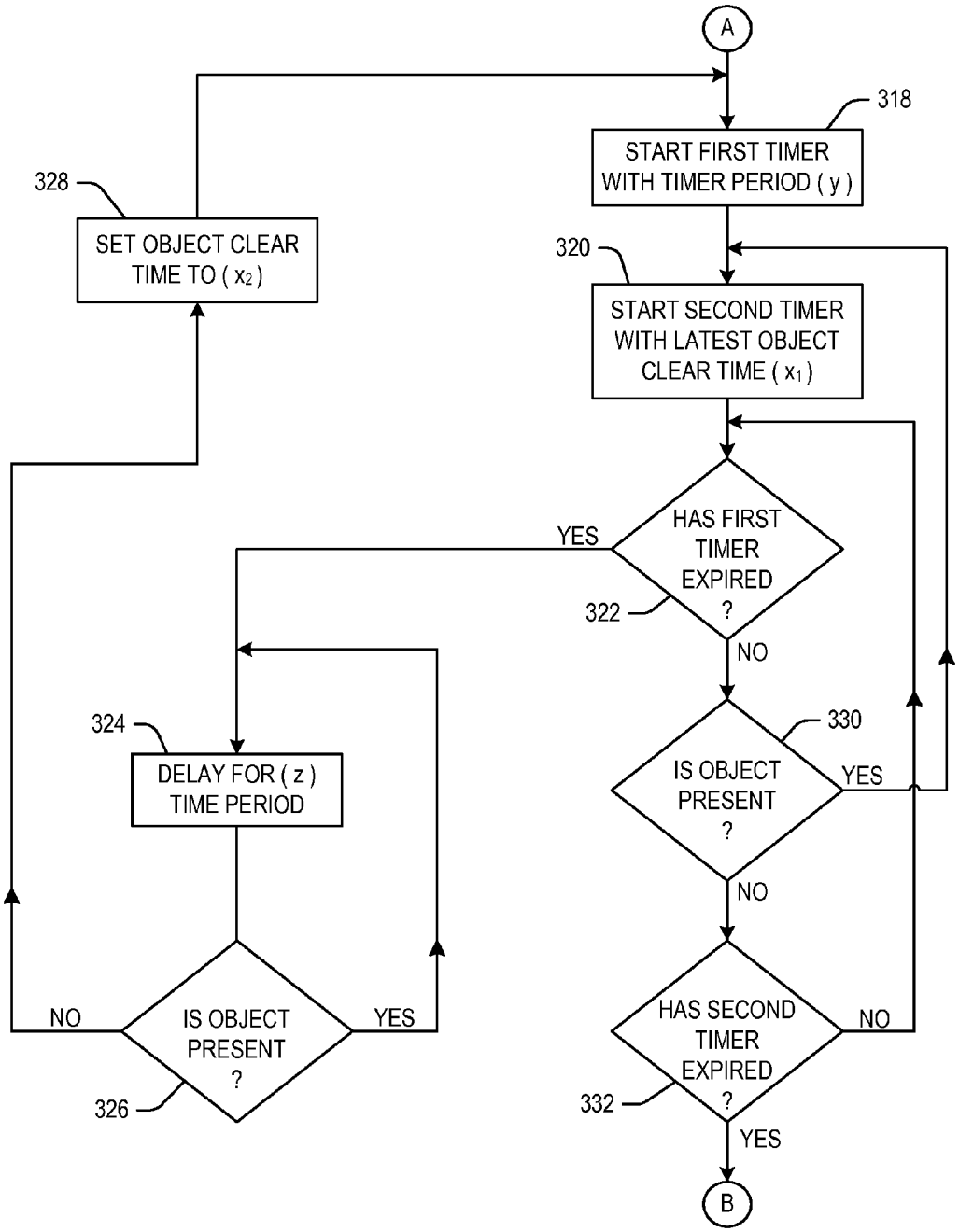
Figure 3C:
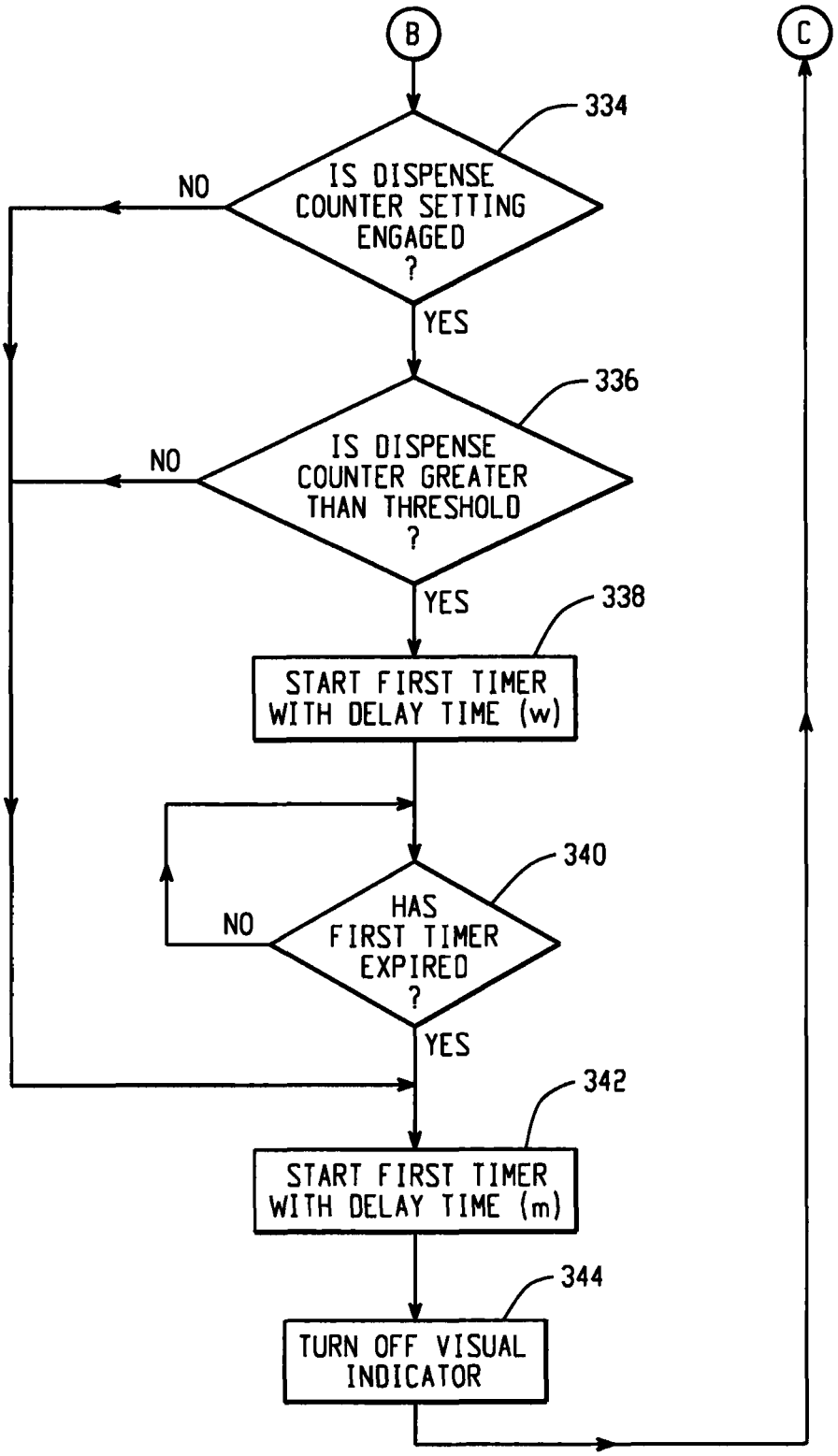

FIGS. 3A-3C include a block diagram of an exemplary method of operation of the dispenser 100 (of FIG. 1A) that may be implemented by the processor 202 (of FIG. 2). In this regard, the logic implemented by the processor 202 uses an arrangement of timers and counters to mitigate undesired dispensing of flowable liquid, particularly in instances where the sensor 106 may be obstructed by flowable liquid. Referring to FIG. 3A, in block 302, a first timer is set to expired. In block 304, the processor 202 determines whether the first timer has expired. If yes, a dispense counter is cleared (i.e., set to zero) in block 306. The dispense counter is operative to maintain a count of the number of dispenses of product that have occurred. In block 308, the processor 202 determines whether an object is present (e.g., a user has placed a hand or other object in proximity to the sensor 106 (of FIG. 1B)). If an object is present, the visual indicator 208 (of FIG. 2) is turned on in block 310. In block 312, the dispense counter is incremented, and in block 314, the product is dispensed. In block 316, an object clear time value is set to a first value ($x_1$). In the illustrated embodiment, the value $x_1$ includes a relatively short time period such as, for example less than one second. However, any desired time period may be used.

Referring to FIG. 3B, in block 318 a first timer is started with a timer period (y). In the illustrated embodiment, the timer period is approximately five seconds however; any desired timer period may be used. In block 320, a second timer is started with a timer setting of the latest object clear time value. In this regard, the latest object clear time value is $x_1$ as set above in block 316. In block 322, the processor 202 determines whether the first timer has expired. If yes, the processor 202 delays the logic progression for a time period (z) in block 324. In the illustrated embodiment, the time period (z) is relatively short, for example, less than one second however; any desired time period may be used. In block 326, the processor 202 determines whether an object is present (in this regard, an object may include the hand of the user, or another object such as soap that may obstruct the sensor 106 (of FIG. 1B). The object clear time is set to a value ($x_2$) in block 328. In the illustrated embodiment, the object clear time value $x_2$ is relatively greater than the object clear time value $x_1$ described above. For example, the value $x_2$ is set to 2.5 seconds; however, any desired value $x_2$ may be used. In summary, the first timer has been set to value y (e.g., five seconds). In block 322 if the time period has expired, the processor 202 delays for a relatively short period of time, and determines whether an object is present, if an object is not present, the processor sets the object clear time value to $x_2$.

In block 330, the processor 202 determines whether an object is present. If no, the processor 202 determines if the second timer has expired in block 332. As discussed above, the second timer is set to an object clear time x. Depending on the logical path followed, the object clear time value may be either $x_1$ or $x_2$.

Referring to FIG. 3C, in block 334, the processor 202 determines whether the dispense counter feature is engaged. In this regard, a user may activate the dispense counter by actuating or engaging the dispense counter setting input 210 (of FIG. 2), which may include for example, setting a switch or other input device to a position that activates the dispense counter. This feature may be used when, for example, a user desires to limit a number of product dispensing cycles over a time period. The illustrated embodiment may include a single switch that toggles the setting, or may include multiple switches such as dual in-line package (DIP) switches that allow the user to activate the dispense counter and set a desired threshold for the counter. Alternatively, the dispense counter may be factory set as a default mode of operation for the dispenser 100. If the dispense counter is not active, the first timer is set to a delay time (m) and started in block 342. In the illustrated embodiment, the delay time may be approximately five seconds, however other desired delay times m may be used. The visual indicator 208 (of FIG. 2) is turned off in block 344.

If the dispense counter is active (in block 334), the processor 202 determines whether the dispense counter is greater than a threshold value in block 336. In the illustrated embodiment, the threshold is two, however the threshold may be set to any desired value. If the dispense counter is greater than the threshold, in block 338, the first timer is started with a delay time (w). The delay time w in the illustrated embodiment is approximately five seconds, however any desired delay time w may be used. In block 340, the processor 202 determines whether the first timer has expired. If yes, the processor 202 starts the first timer with the delay time m in block 342.

Figure 4A:
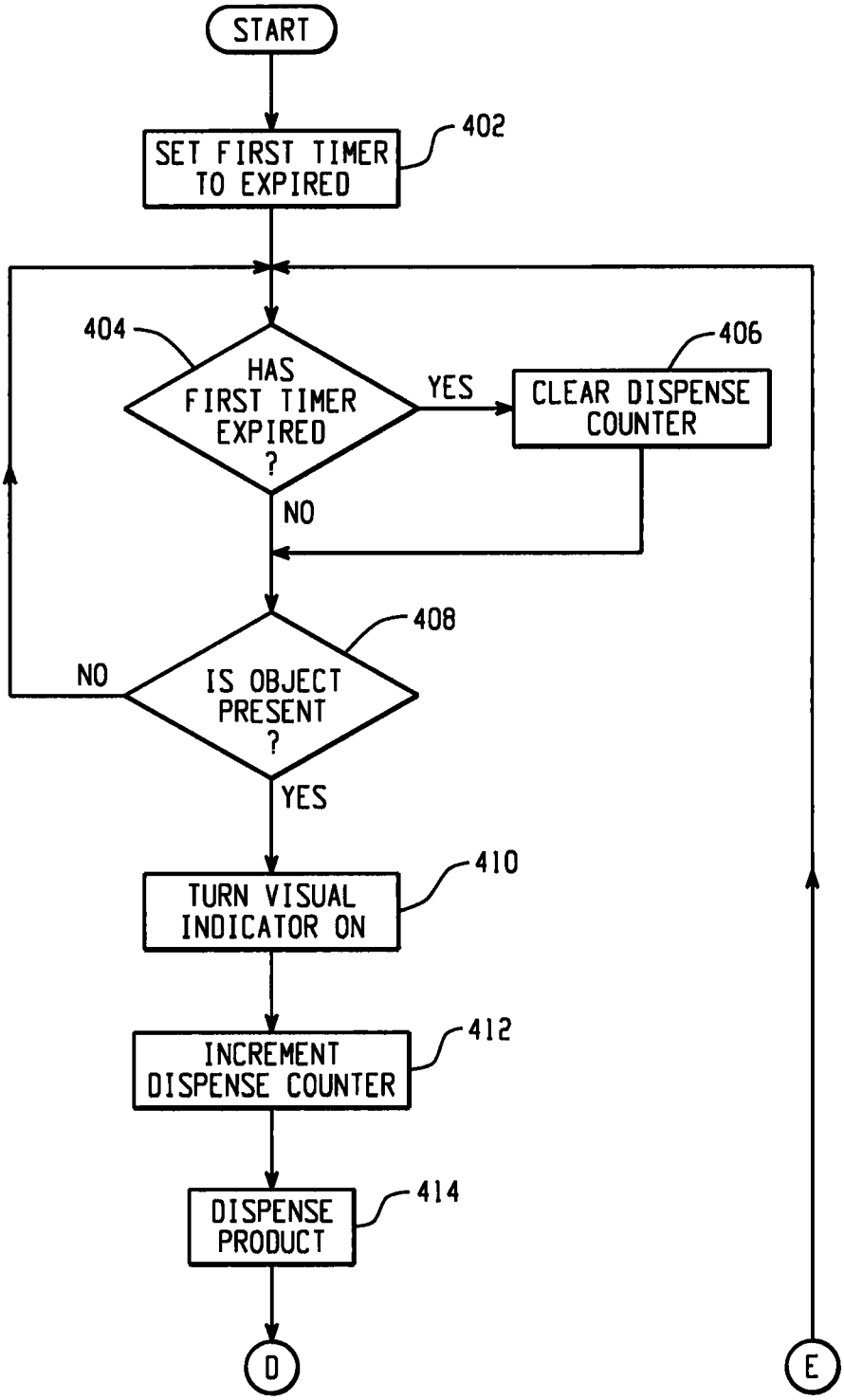
FIGS. 4A-4B include a block diagram of an alternate exemplary method of operation of the system of FIGS. 1A, 1B, and 2.
Figure 4B:
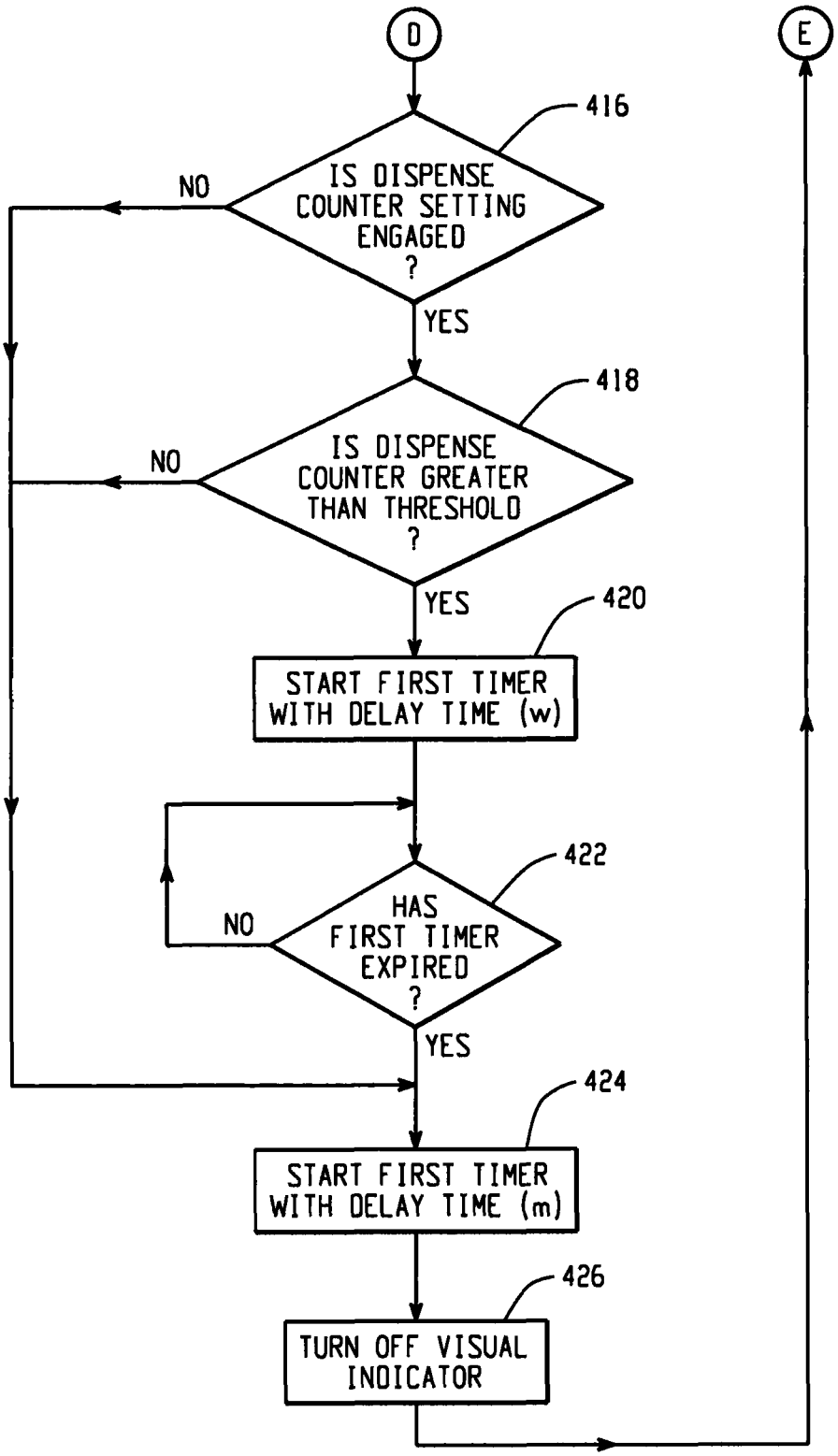

FIGS. 4A-4B include a block diagram of an alternate exemplary method of operation of the dispenser 100 (of FIG. 1A) that may be implemented by the processor 202 (of FIG. 2). Referring to FIG. 4A, in block 402, a first timer is set to expired. In block 404, the processor 202 determines whether the first timer has expired. If yes, a dispense counter is cleared (i.e., set to zero) in block 406. The dispense counter is operative to maintain a count of the number of dispenses of product that have occurred. If no, the processor continues to block 408. In block 408, the processor 202 determines whether an object is present (e.g., a user has placed a hand or other object in proximity to the sensor 106 (of FIG. 1B)). If an object is present, the visual indicator 208 (of FIG. 2) may be turned on in block 410. If an object is not present, the processor 202 returns back to block 404 to determine whether the first timer has expired. Alternate embodiments of the dispenser 100 may not include a visual indicator; for such embodiments, the exemplary method would not operate a visual indicator, and would, for example, logically pass over the visual indicator operations. In block 412, the dispense counter is incremented, and in block 414, the product is dispensed.

Referring to FIG. 4B, in block 416, the processor 202 determines whether the dispense counter feature is engaged. In this regard, a user may activate the dispense counter by actuating or engaging the dispense counter setting input 210 (of FIG. 2), which may include for example, setting a switch or other input device to a position that activates the dispense counter. If the dispense counter is not active, the first timer is set to a delay time (m) and started in block 424. In the illustrated embodiment, the delay time may be approximately five seconds, however other desired delay times m may be used. The visual indicator 208 (of FIG. 2) is turned off in block 426.

If the dispense counter setting is engaged (in block 416), the processor 202 determines whether the dispense counter is greater than a threshold value in block 418. In the illustrated embodiment the threshold is two; however, the threshold may be set to any desired value using, for example, the dispense counter setting input 210 (of FIG. 2). If the dispense counter is greater than the threshold, in block 420, the first timer is started with a delay time (w). The delay time w in the illustrated embodiment is approximately five seconds; however, any desired delay time w may be used. In block 422, the processor 202 determines whether the first timer has expired. If yes, the processor starts the first timer with the delay time m in block 424.

Figure 5:
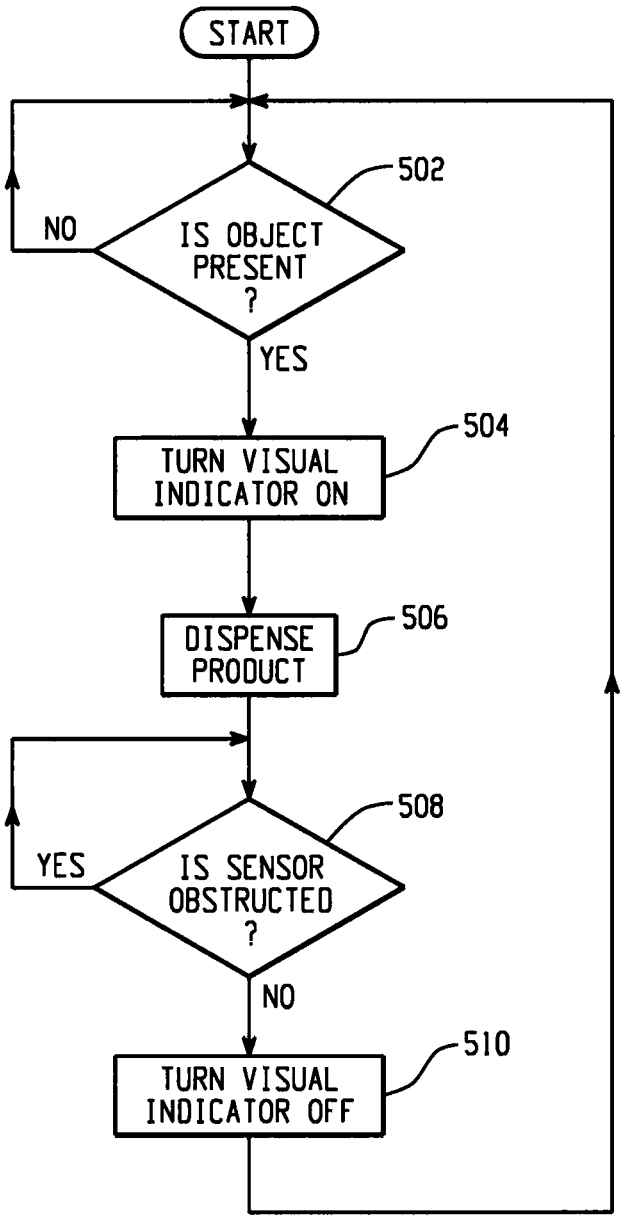
FIG. 5 includes a block diagram of another alternate exemplary method of operation of the system of FIGS. 1A, 1B, and 2.

FIG. 5 includes a block diagram of another alternate exemplary method of operation of the dispenser 100 (of FIG. 1A) that may be implemented by the processor 202 (of FIG. 2). Referring to FIG. 5, in block 502, the processor 202 determines whether an object is present (e.g., a user has placed a hand or other object in proximity to the sensor 106 (of FIG. 1B)). If an object is present, the visual indicator 208 (of FIG. 2) is turned on in block 504. In block 506, the product is dispensed. The processor 202 determines whether the sensor 106 is obstructed in block 508. The processor 202 may determine whether the sensor is obstructed by, for example, determining whether an object or dispensed product is present (e.g., obstructing) or sensed by the sensor 106, and in some embodiments, using timers (similar to the timers described above) to time and/or delay the logical process. The visual indicator 208 is turned off in block 510 responsive to determining that the sensor is not obstructed.

The technical effects and benefits described above include a product dispenser system and method that determines whether an object has been placed proximate to a sensor, and dispenses a flowable liquid responsively. The dispenser is operative to use a variety of timing and counting methods to reduce the possibility that the dispenser may undesirably dispense flowable liquid.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A method for dispensing a product, comprising:
determining that an object is sensed by a sensor;
dispensing a product responsive to determining that the object has been sensed by the sensor;
setting an object clear time parameter to a first value;
setting a first timer to a first time period and starting the first timer;
setting a second timer to the first value and starting the second timer;
determining that the first timer has not expired past the first time period;
determining that the sensor is obstructed responsive to determining that the first timer has not expired;
re-setting the second timer to the first value and re-starting the second timer responsive to determining that the sensor is obstructed;
determining that the first timer has expired past the first time period;
determining that the sensor is not obstructed responsive to determining that the first timer has expired; and
setting the object clear time parameter to a second value responsive to determining that the sensor is not obstructed.

2. The method of claim 1, further comprising:
setting the first timer to the first time period and starting the first timer responsive to setting the object clear time parameter to the second value;
setting the second timer to the second value and starting the second timer;
determining that the first timer has not expired past the first time period;
determining that the sensor is not obstructed responsive to determining that the first timer has not expired past the first time period;
determining that the second timer has expired responsive to determining that the sensor is not obstructed; and
setting the first timer to a second time period and starting the first timer.

3. The method of claim 2, further comprising:
determining that a dispense counter setting is engaged responsive to determining that the second timer has expired;
determining that a dispense counter has an incremented value greater than a threshold value responsive to determining that the dispense counter setting is engaged;
setting the first timer to a fourth time period and starting the first timer responsive to determining that the incremented value of the dispense counter is greater than the threshold value;
determining that the first timer has expired past the fourth time period; and
turning off the visual indicator responsive to starting the first timer,
wherein the first timer is set to the second time period and started responsive to determining that the first timer has expired past the fourth time period.

4. The method of claim 3, wherein the fourth time period is less than six seconds.

5. The method of claim 2, further comprising:
turning on a visual indicator responsive to determining that the object has been sensed by the sensor; and
turning off the visual indicator responsive to setting the first timer to the second time period and starting the first timer.

6. The method of claim 1, wherein the determining that the sensor is not obstructed is delayed for a third time period responsive to determining that the first timer has expired.

7. The method of claim 6, wherein the second time period is less than 45 seconds and the third time period is less than one second.

8. The method of claim 1, further comprising:
incrementing a dispense counter prior to dispensing the product.

9. The method of claim 8, further comprising:
determining that the first timer has expired prior to determining that the object is sensed by the sensor; and
clearing the dispense counter responsive to determining that the first timer has expired prior to determining that the object is sensed by the sensor.

10. The method of claim 1, wherein the first time period is less than eight seconds, the first value is less than one second, and the second value is less than 4 seconds.

11. The method of claim 1, wherein the product includes a flowable liquid.

12. The method of claim 1, wherein the sensor is obstructed by at least a portion of the dispensed product.

13. The method of claim 1, wherein the object is a first object, the method further comprising:
determining that a second object is sensed by the sensor;
dispensing the product responsive to determining that the second object has been sensed by the sensor;
setting the object clear time parameter to the first value;
setting the first timer to the first time period and starting the first timer;
setting the second timer to the first value and starting the second timer;

determining that the first timer has not expired past the first time period;

determining that no object is currently being sensed by the sensor responsive to determining that the first timer has not expired;

determining that the second timer has expired past the first value responsive to determining that no object is currently being sensed by the sensor; and setting the first timer to the second time period and starting the first timer responsive to determining that the second timer has expired.

14. A dispensing system comprising:

a sensor;

a product dispensing portion;

a memory storing executable instructions; and a processor communicatively connected to the sensor, the product dispensing portion, and the memory, the processor operative to execute the executable instructions to determine that an object is sensed by a sensor, dispense a product responsive to determining that the object has been sensed by the sensor, set an object clear time parameter to a first value, set a first timer to a first time period and start the first timer, set a second timer to the first value and start the second timer, determine that the first timer has not expired past the first time period, determine that the sensor is obstructed responsive to determining that the first timer has not expired, reset the second timer to the first value and restart the second timer responsive to determining that the sensor is obstructed, determine that the first timer has expired past the first time period, determine that the sensor is not obstructed responsive to determining that the first timer has expired, and set the object clear time parameter to a second value responsive to determining that the sensor is not obstructed.

15. The system of claim 14, wherein the processor is further operative to execute the executable instructions to set the first timer to the first time period and start the first timer responsive to setting the object clear time parameter to the second value, set the second timer to the second value and start the second timer, determine that the first timer has not expired past the first time period, determine that the sensor is not obstructed responsive to determining that the first timer has not expired past the first time period, determine that the second timer has expired responsive to determining that the sensor is not obstructed, and set the first timer to a second time period and start the first timer.

16. The system of claim 15, wherein the processor is further operative to execute the executable instructions to determine that a dispense counter setting is engaged responsive to determining that the second timer has expired, determine that a dispense counter has an incremented value greater than a threshold value responsive to determining that the dispense counter setting is engaged, set the first timer to a fourth time period and start the first timer responsive to determining that the incremented value of the dispense counter is greater than the threshold value, determine that the first timer has expired past the fourth time period, and turn the visual indicator off responsive to starting the first timer, wherein the first timer is set to the second time period responsive to determining that the first timer has expired past the fourth time period.

17. The system of claim 16, wherein the fourth time period is less than six seconds.

18. The system of claim 15, wherein the system further includes a visual indicator communicatively connected to the processor, and wherein the processor is further operative to execute the executable instructions to turn on the visual indicator responsive to determining that the object has been sensed by the sensor, and turn off the visual indicator responsive to setting the first timer to the second time period and starting the first timer.

19. The system of claim 14, wherein the processor is further operative to execute the executable instructions to delay the determination that the sensor is not obstructed for a third time period responsive to determining that the first timer has expired.

20. The system of claim 19, wherein the second time period is less than 45 seconds and the third time period is less than one second.

21. The system of claim 14, wherein the processor is further operative to execute the executable instructions to increment a dispense counter prior to dispensing the product.

22. The system of claim 21, wherein the processor is further operative to execute the executable instructions to determine that the first timer has expired prior to determining that the object is sensed by the sensor, and clear the dispense counter responsive to determining that the first timer has expired prior to determining that the object is sensed by the sensor.

23. The system of claim 14, wherein the first time period is less than eight seconds, the first value is less than one second, and the second value is less than 4 seconds.

24. The system of claim 14, wherein the product includes a flowable liquid.

25. The system of claim 14, wherein the sensor is obstructed by at least a portion of the dispensed product.

26. The system of claim 14, wherein the object is a first object, and wherein the processor is further operative to execute the executable instructions to determine that a second object is sensed by the sensor, dispense the product responsive to determining that the second object has been sensed by the sensor, set the object clear time parameter to the first value, set the first timer to the first time period and start the first timer, set the second timer to the first value and start the second timer, determine that the first timer has not expired past the first time period, determine that no object is currently being sensed by the sensor responsive to determining that the first timer has not expired, determine that the second timer has expired past the first value responsive to determining that no object is currently being sensed by the sensor, and set the first timer to the second time period and start the first timer responsive to determining that the second timer has expired.

* * * * *